US006315600B1

(12) United States Patent
Droesbeke

(10) Patent No.: US 6,315,600 B1
(45) Date of Patent: Nov. 13, 2001

(54) CABLE CONNECTOR AND METHOD FOR CONNECTING A CABLE TO A CABLE CONNECTOR

(75) Inventor: Gert Droesbeke, Nijlen (BE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/507,970

(22) Filed: Feb. 22, 2000

(30) Foreign Application Priority Data

Feb. 23, 1999 (NL) ..... 1011376

(51) Int. Cl.[7] ..... H01R 13/58
(52) U.S. Cl. ..... 439/460; 439/368; 439/472
(58) Field of Search ..... 439/460, 469, 439/470, 472, 465, 359, 368, 372; 174/52.1

(56) References Cited

U.S. PATENT DOCUMENTS

| | | | | |
|---|---|---|---|---|
| 3,497,923 | | 3/1970 | Seckerson et al. | 24/81 |
| 5,021,610 | | 6/1991 | Roberts | 174/65 R |
| 5,315,062 | * | 5/1994 | Hoshino | 174/52.1 |
| 5,439,388 | * | 8/1995 | Weiss et al. | 439/417 |
| 5,503,568 | * | 4/1996 | Pryce | 439/427 |
| 5,511,993 | | 4/1996 | Yamada et al. | 439/610 |
| 5,529,522 | * | 6/1996 | Huang | 439/460 |
| 5,653,609 | * | 8/1997 | Orstad et al. | 439/472 |

FOREIGN PATENT DOCUMENTS

0653810A1 5/1995 (EP) .

* cited by examiner

*Primary Examiner*—Paula Bradley
*Assistant Examiner*—James Harvey

(57) ABSTRACT

A cable connector for a cable with a plurality of insulated wires comprises a housing of insulating material accommodating a plurality of contacts to be connected to the wires, a mainly hollow hood connected to the housing and having a strain relief element to maintain the cable stationary with respect to the hood. The hood comprises first and second hood parts which can be interconnected. The strain relief element is adapted to surround at least partially the cable. The strain relief element is pressed on the cable by co-operation with one of the hood parts during interconnecting the first and second hood parts. Further, the strain relief element is fixed within the first and second hood parts by interconnecting these hood parts.

10 Claims, 7 Drawing Sheets

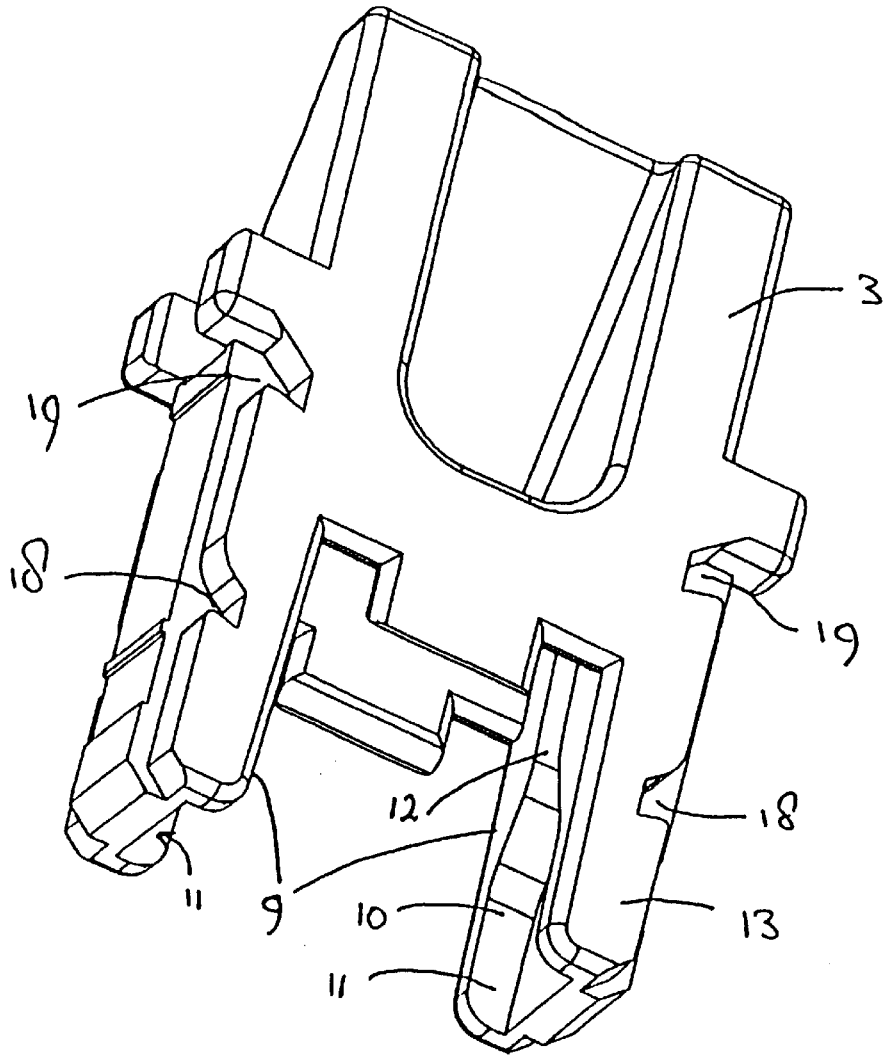
fig.3
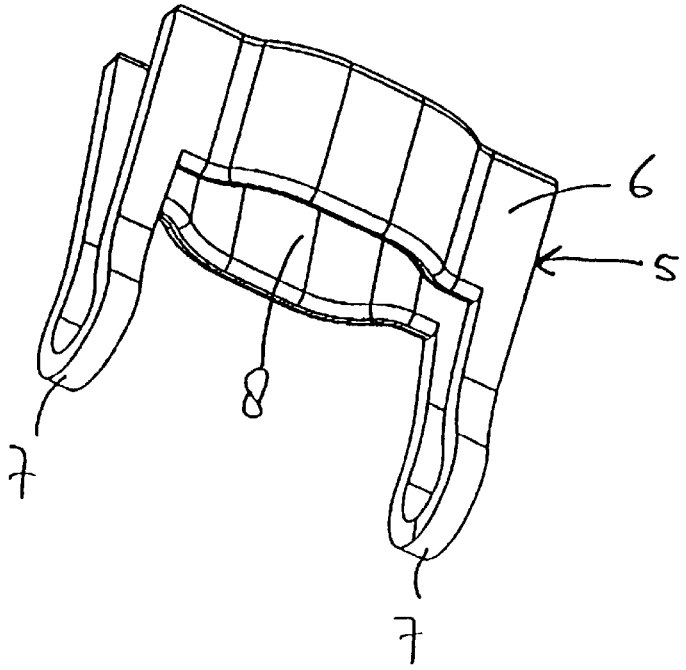

CABLE CONNECTOR AND METHOD FOR CONNECTING A CABLE TO A CABLE CONNECTOR

The invention relates to a cable connector for a cable with a plurality of insulated wires, comprising a housing of insulating material accommodating a plurality of contacts to be connected to the wires, a mainly hollow hood connected to the housing and having a strain relief element to maintain the cable stationary with respect to the hood, and to a method for connecting a cable to a cable connector.

In the known cable connector of this type, the strain relief element is generally mounted in the hood by means of screws which need to be tightened in order to activate the strain relief element to fix the cable with respect to the hood. Therefore, providing a strain relief in the known cable connector on the one hand requires a plurality of separate components and on the other hand requires assembling steps when the cable is connected to the cable connector.

It is an object of the invention to improve the cable connector of the above-mentioned type.

To this end the cable connector of the invention is characterized in that the hood comprises first and second hood parts which can be interconnected, wherein the strain relief element is adapted to surround at least partially the cable, wherein the strain relief element is adapted to clamp the cable by co-operation with one of the hood parts during interconnecting the first and second hood parts, and wherein the strain relief element is adapted to be fixed within the first and second hood parts by interconnecting these hood parts.

In this manner a cable connector is obtained, wherein activating the strain relief element is obtained by interconnecting the hood parts, so that no separate components and no separate assembling steps are necessary.

According to a preferred embodiment, the first and second hood parts can be interconnected in intermediate and final positions, wherein the hood parts can be slid from the intermediate into the final position, wherein in the intermediate position the strain relief element provides a passage for the cable and in the final position the strain relief element is forced to clamp the cable.

In this manner a cable connector is obtained, wherein the hood parts and strain relief element are available as a preassembled component so that activating the strain relief element is a very simple manufacturing step.

The invention further provides an improved method of the above-mentioned type, characterized in that a cable connector is used, having a hood comprising first and second hood parts, wherein the cable is pushed through the hood parts and the strain relief element, wherein after connecting the wires to the contacts, the hood parts are fully interconnected and the strain relief element is thereby forced to clamp the cable by co-operation with one of the hood parts during interconnecting the first and second hood parts, wherein the strain relief element is fixed within the first and second hood parts by interconnecting these hood parts.

In the preferred embodiment of the method of the invention the first and second hood parts and strain relief element are preassembled, the hood parts being in an intermediate position enclosing the strain relief element, wherein the cable is pushed through the preassembled hood parts and strain relief element, wherein after connecting the wires to the contacts, the hood parts are slid from the intermediate position into a final position in which the strain relief element clamps the cable.

The invention will be further explained by reference to the drawings in which embodiments of the cable connector and method of the invention are schematically shown.

FIG. 3 shows a perspective view of the first hood part and the strain relief element.

Figure 1:
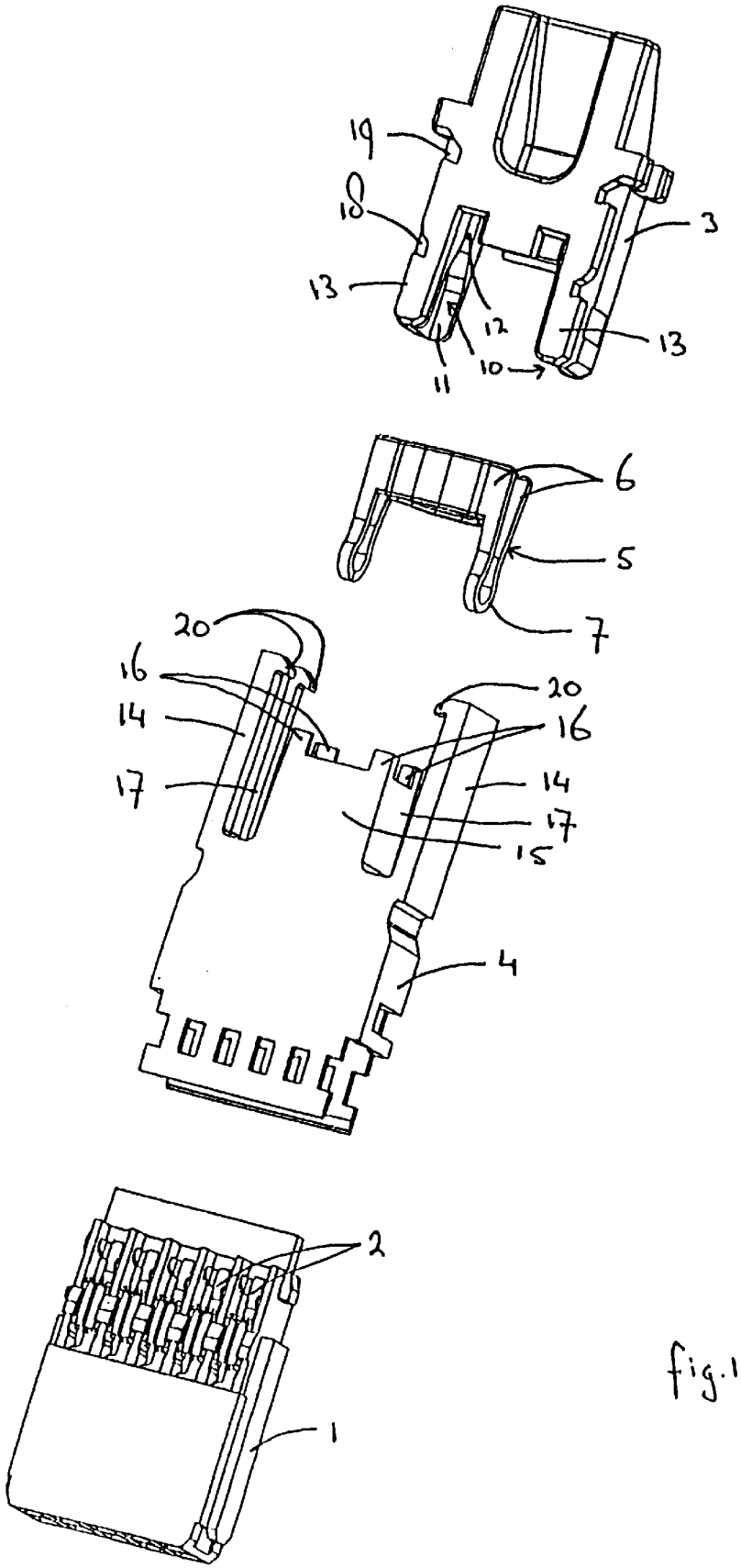
FIG. 1 is an exploded view of an embodiment of the cable connector of the invention.
Figure 2:
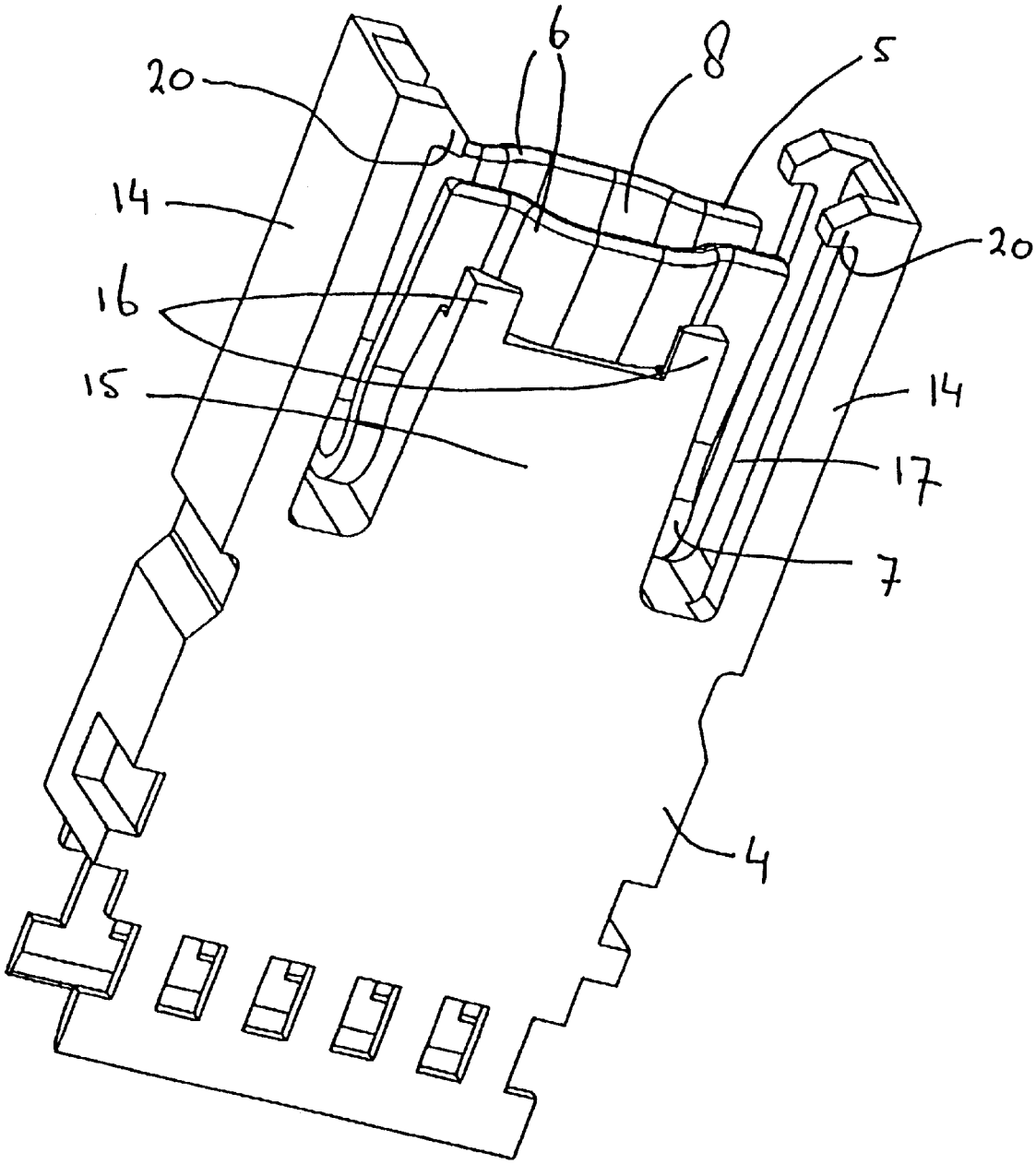
FIG. 2 is a perspective view of the second hood part with the strain relief element of the cable connector of FIG. 1.

As shown in FIGS. 1–3 the cable connector comprises a housing 1 of insulating material accommodating a plurality of contacts 2 to be connected to the wires of a cable not shown. In the embodiment described, the contacts 2 are contacts of the so-called IDC type. The cable connector is further provided with a mainly hollow hood comprising a first hood part 3 and a second hood part 4, which hood parts 3,4 can be interconnected as will be described later. Finally, the cable connector comprises a strain relief element 5 adapted to fix the cable with respect to the hood 3,4. In the embodiment described, the first hood part 3 is made of metal, while the second hood part 4 is made of plastic material.

The strain relief element 5 is also made of metal and comprises two halves 6 interconnected by mainly U-shaped sections 7. The strain relief element halves 6 determine a passage 8 for a cable, so that the strain relief element can surround the cable at least partially. By forcing the strain relief element halves 6 towards each other, the cable extending through the passage 8 will be clamped by the strain relief element 5.

In the cable connector described, the strain relief element 5 is forced to clamp the cable by cc-operation with the first hood part 3 during interconnecting the first and second hood parts 3,4 as will be described by reference to FIGS. 4–10.

For forcing the strain relief element 5 to clamp the cable, the first hood part 3 is provided with two opposite inner walls 9, each inner wall 9 having a slot 10 which is open at its side directed towards the second hood part 4 as shown in FIGS. 1 and 3. Each slot 10 includes a first section 11 with constant width starting at the open end of the slot. This first section 11 is joined by a second section 12 with decreasing width. During interconnecting the first and second hood parts 3,4, the strain relief element 5 is first introduced into the first section 11 of the slot 10 and thereafter into the second slot section 12. In this second slot section 12, the strain relief element halves 6 are moved towards each other and thereby clamped on the cable.

For interconnecting the first and second hood parts 3,4, the first hood part is provided with two lateral extended first locking sections 13, while the second hood part 4 is provided with two lateral extended second locking sections 14. Further, the second hood part 4 has a central section 15 for positioning the strain relief element 5 as shown in FIG. 2. To this end the central section 15 is provided with four positioning or locating projections 16 engaging the outer side of the strain relief element 5. As shown in FIG. 2, the U-shaped sections 7 of the strain relief element 5 are received in receiving spaces 17 enclosed between the second locking sections 14 and the central section 15. The first locking sections 13 of the first hood part 3 are also received in these receiving spaces 17 during interconnecting the hood parts 3,4.

The first locking sections 13 each are provided with two pairs of locking recesses 18,19, whereas the second locking sections 14 are provided with locking hooks 20 adapted to engage into the recesses 18 or 19. When the locking hooks 20 engage into the recesses 18, the first and second hood parts are interconnected in an intermediate position, wherein the strain relief element 5 is received between the flood parts 3,4, the strain relief element 5 being in the first section 11 of the slots 10. In this position a cable can pass through the passage 8 of the strain relief element 5. The hood parts 3,4 can easily be slid from the intermediate into a final position, in which the locking hooks 20 engage into the recesses 19. In this position, tile strain relief element 5 is forced into the second section 12 of the slots 10 and thereby the strain relief element 5 is also forced to clamp a cable extending through the passage 8.

A first method for connecting a cable 21 to the cable connector described, will be explained by reference to FIGS. 4–10.

Figure 4:
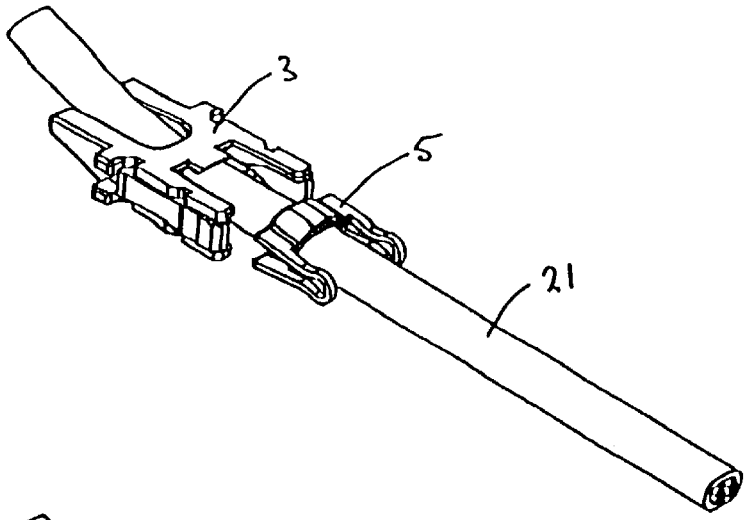
FIGS. 4–10 show a plurality of step, of a first embodiment of the method of the invention.
Figure 5:
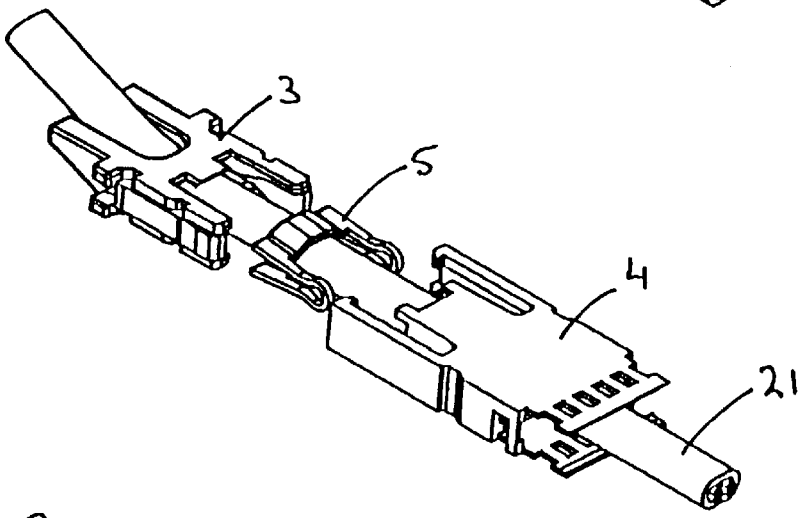
Figure 6:
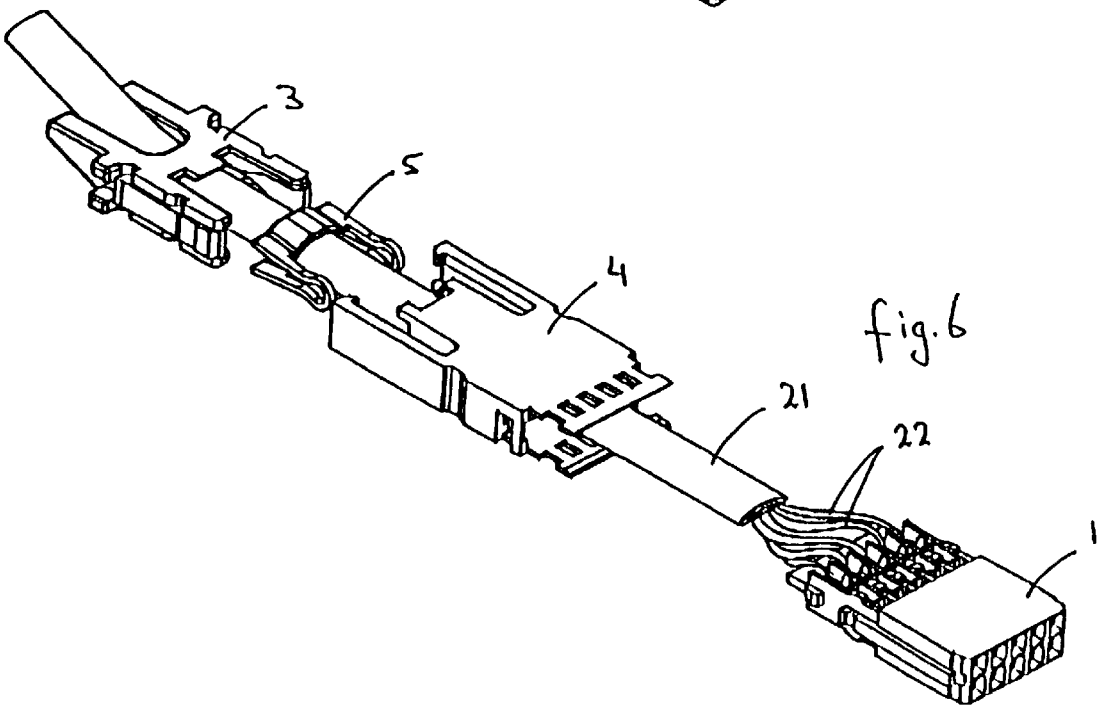
Figure 7:
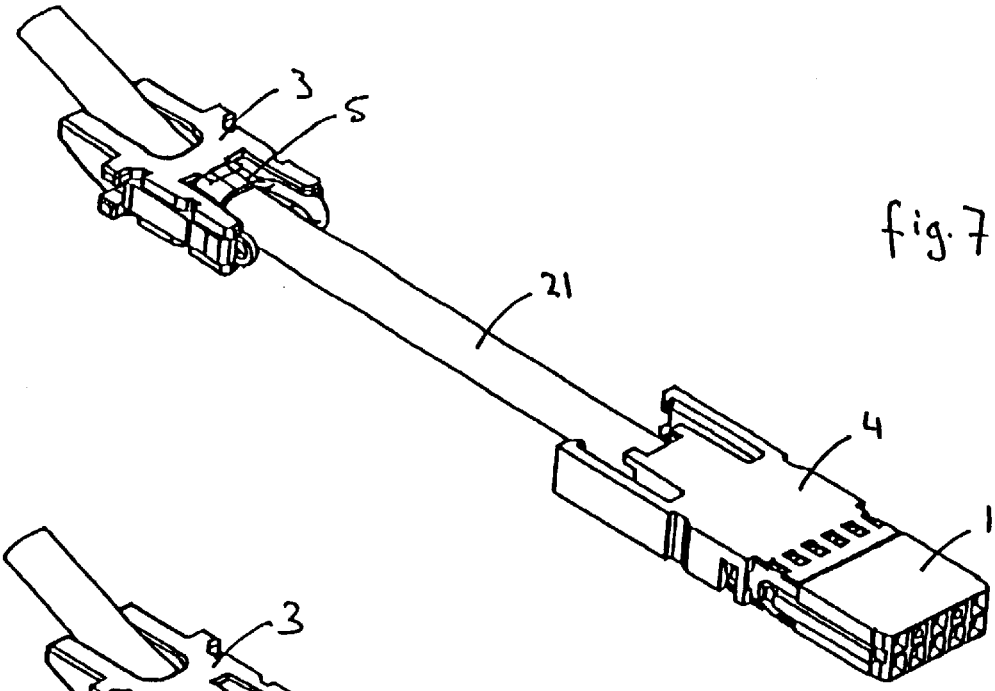
Figure 8:
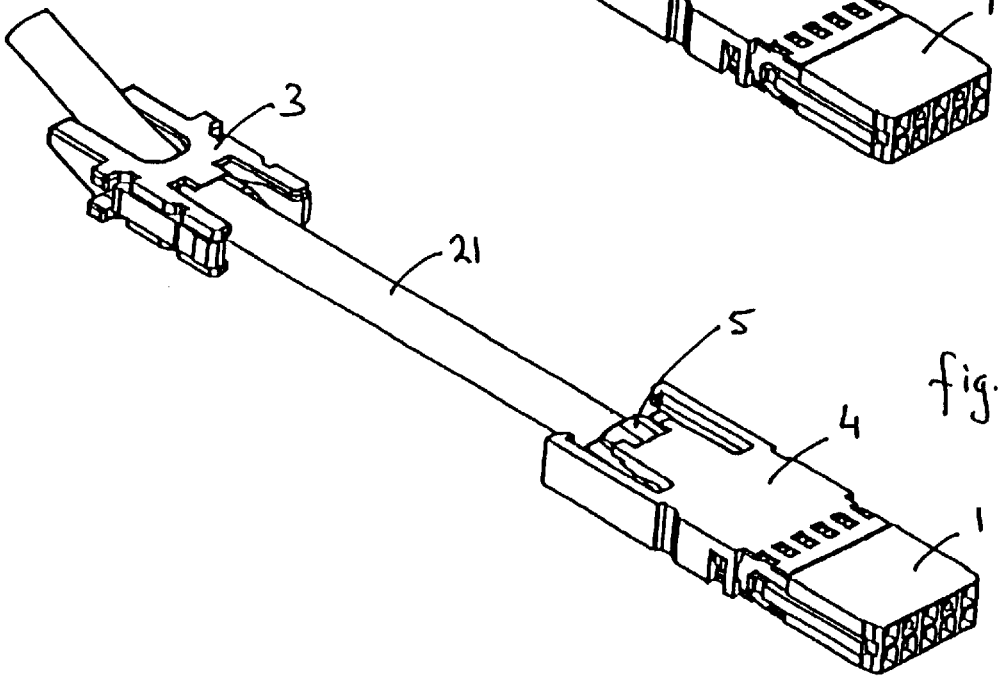
Figure 9:
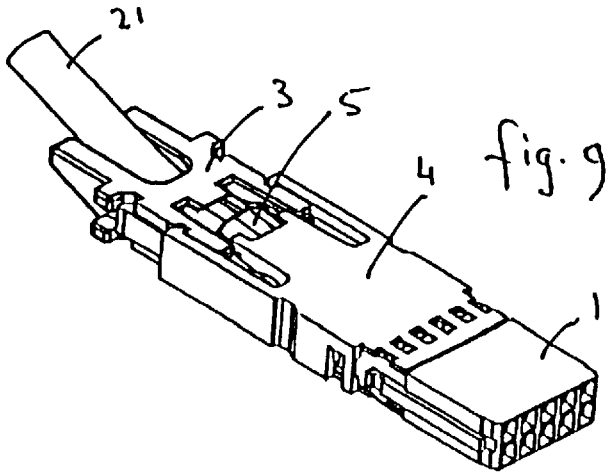
Figure 10:
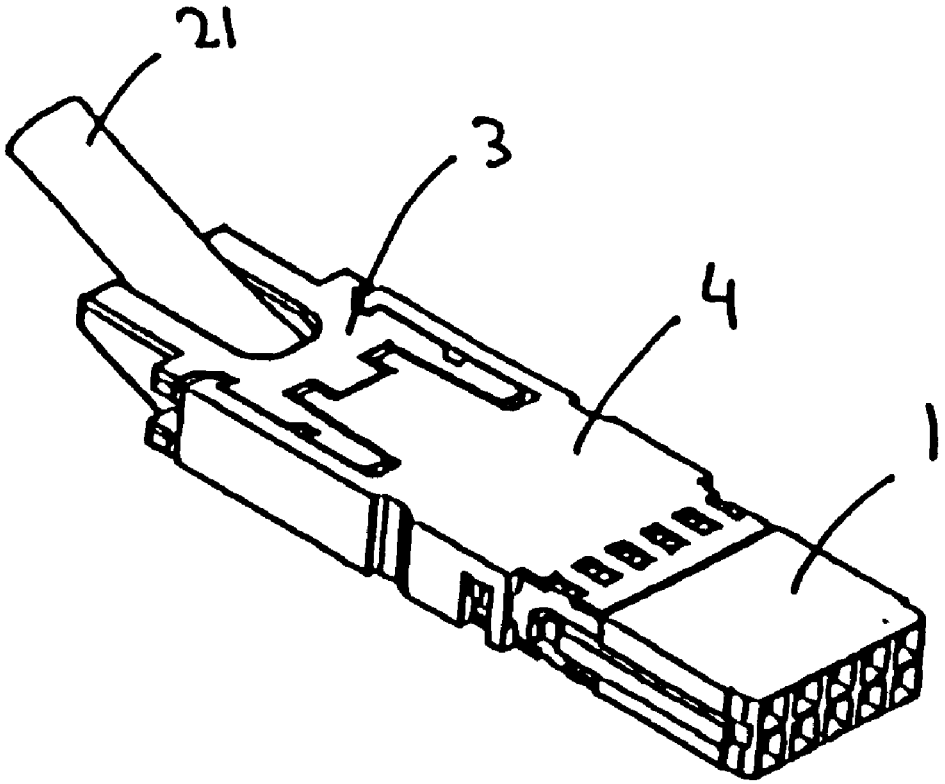

As shown in FIGS. 4 and 5, the cable 21 is slid through the hollow first hood part 3, through the passage 8 of the strain relief element 5 and through the hollow second hood part 4. Thereafter the wires 22 of the cable 21 are connected to the contacts 2 accommodated in the housing 1. As shown in FIG. 7, the housing 1 is received in the open end of the second hood part 4 directed away from the first hood part 3. Then the strain relief element 5 is positioned between the four positioning projections 16 of the central section 15. The first hood part 3 is slid down and clicked into the second hood part 4, wherein the second locking sections 14 slide on the outer side of the first locking sections 13 until the locking hooks 20 are received in the first pair of recesses 18. Finally the first hood part 3 is moved further down into the second hood part 4, until the locking hooks 20 engage into the final recesses 19 to obtain the complete assembled cable connector as shown in FIG. 10.

Figure 11:
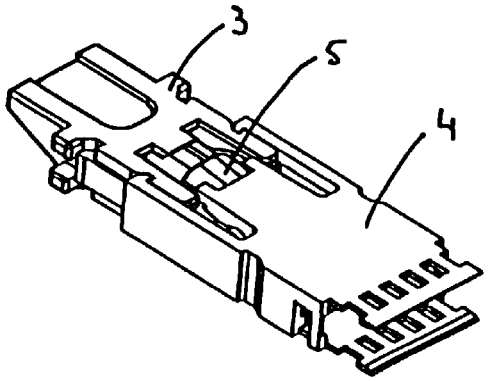
FIGS. 11 and 12 show two steps of a second embodiment of the method of the invention.
Figure 12:
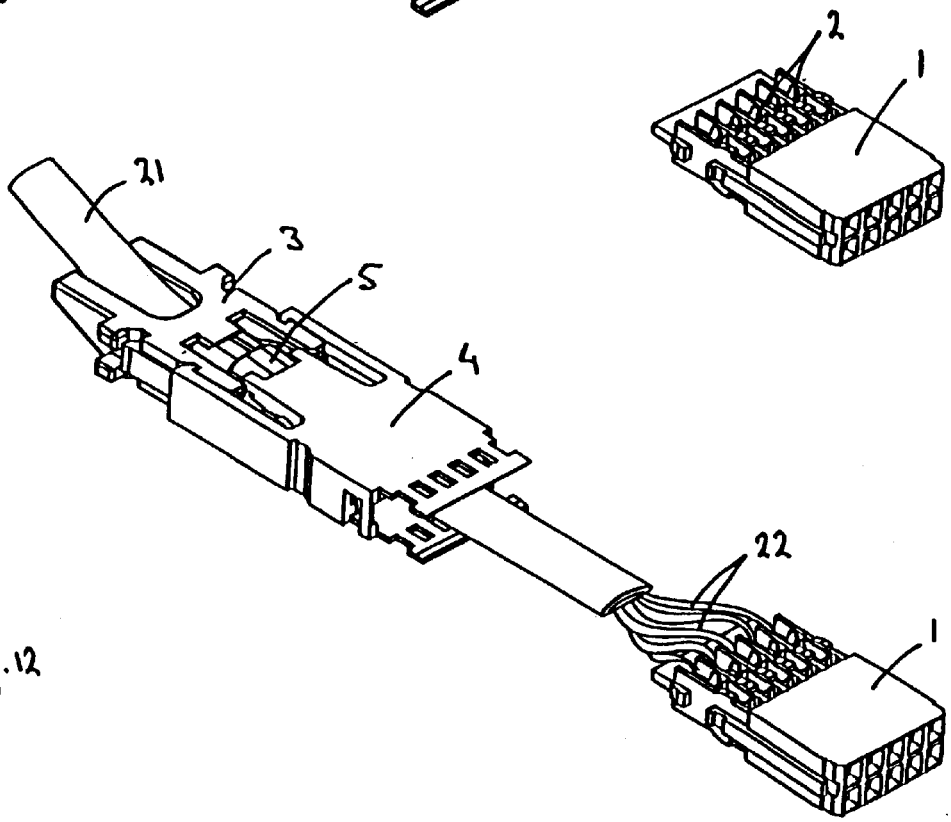

As an alternative, the cable connector can be provided in a preassembled position as shown in FIG. 11. In this preassembled position, the first and second hood parts 3,4 are in the intermediate position. In this intermediate position, the passage 8 of the strain relief element 5 still can receive the cable 21 and the cable can be moved through this passage 8. In this intermediate position, the cable is slid through the first and second hood parts; 3,4 and the strain relief element 5, whereafter the wires 22 can be connected to the contacts 2, as shown in FIG. 12. Then, the housing 1 is clicked into the open end of the second hood part 4 in the same manner as shown in FIG. 7. Thereafter the first hood part 3 is moved further down into the second hood part 4 to obtain the final position shown in FIG. 10.

It will be clear that the invention provides a cable connector, wherein only one strain relief element is required to provide a strain relief for the cable. Assembling the cable connector and connecting a cable to the cable connector is relatively easy, wherein no separate assembling steps are necessary to activate the strain relief element.

The invention is not restricted to the above-described embodiments which can be varied in a number of ways within the scope of the claims.

What is claimed is:

1. Cable connector for a cable with a plurality of insulated wires, comprising a housing of insulating material accommodating a plurality of contacts to be connected to the wires, a hollow hood connected to the housing and having a strain relief element to fix the cable with respect to the hood, wherein the hood comprises first and second hood parts which can be interconnected, wherein the strain relief element is adapted to surround at least partially the cable, wherein the strain relieve element is adapted to clamp the cable by co-operation with one of the hood parts during interconnecting the first and second hood parts, and wherein the strain relief element is adapted to be fixed within the first and second hood parts by interconnecting these hood parts and further wherein the first and second hood parts can be interconnected in intermediate and final positions, wherein the hood parts can be slid in the same general direction as the cable axis from the intermediate into the final position, wherein in the intermediate position the strain relief element provides a passage for the cable and in the final position the strain relief element is forced to clamp the cable.

2. Cable connector according to claim 1, wherein the first hood part is provided with two opposite inner walls, each inner wall having a slot which is open at the side directed towards the second hood part to receive one end of the strain relief element, wherein each slot has a section with decreasing width and wherein the strain relief element is slid into the slot during interconnecting the first and second hood parts, the slot sections with decreasing width forcing the strain relief element to clamp the cable.

3. Cable connector according to claim 2, wherein each slot has a section with constant width starting at the open end, the section with decreasing width joining the section with constant width, wherein the strain relief element is in the section with constant width in the intermediate position and in the section with decreasing width in the final position.

4. Cable connector according to claim 2, wherein the strain relief element comprising two halves, corresponding ends of said halves being received in the same slot of the first hood part, wherein the strain relief element halves are moved towards each other by said the slot sections with decreasing width.

5. Cable connector according to claim 2, wherein the first locking sections of the first hood part have said opposite inner walls with said slots.

6. Cable connector according to claim 1, wherein the first hood part is provided with two lateral extended first locking sections, wherein the second hood part is provided with a central section for positioning the strain relief element and two lateral extended second locking sections, each second locking section enclosing a receiving space for the corresponding first locking section, wherein the first and second locking sections are provided with co-operating locking members for interconnecting the first and second hood parts.

7. Cable connector according to claim 6, wherein said co-operating locking members comprise intermediate and final locking members for interconnecting the first and second hood parts in the intermediate and final positions, respectively.

8. Cable connector according to claim 6, wherein the central positioning section of the second hood part is provided with four positioning projections engaging the outer side of the strain relief element supported on the positioning section.

9. Method for connecting a cable with a plurality of insulated wires to a cable connector, said cable connector comprising a housing of insulating material accommodating a plurality of contacts, a hollow hood to be connected to the housing and having a strain relief element for maintaining the cable stationary with respect to the hood, wherein the cable is pushed through the cable hood and the wires are connected to the contacts of the housing, whereafter the strain relief is clamped on the cable, characterized in that a cable connector is used, having a hood comprising first and second hood parts, wherein the cable is pushed through the hood parts and the strain relief element, wherein after connecting the wires to the contacts, the hood parts are fully interconnected and the strain relief element is thereby forced to clamp the cable by co-operation with one of the hood parts during interconnecting the first and second hood parts, wherein the strain relief element is fixed within the first and second hood parts by interconnecting these hood parts.

10. Method according to claim 9, wherein the first and second hood parts and strain relief element are preassembled, the hood parts being in an intermediate position enclosing the strain relief element, wherein the cable is pushed through the preassembled hood parts and strain relief element, wherein after connecting the wires to the contacts, the hood parts are slid from the intermediate position into a final position in which the strain relief element clamps the cable.

* * * * *